US007835132B2

(12) United States Patent
Mesika

(10) Patent No.: US 7,835,132 B2
(45) Date of Patent: Nov. 16, 2010

(54) CONCEALABLE ELECTRIC SHOCK DEVICE

(76) Inventor: Yigal Mesika, 7245 Hillside Ave. #310, Los Angeles, CA (US) 90046

( * ) Notice: Subject to any disclaimer, the term of this patent is extended or adjusted under 35 U.S.C. 154(b) by 313 days.

(21) Appl. No.: 12/082,359

(22) Filed: Apr. 10, 2008

(65) Prior Publication Data

US 2008/0253055 A1 Oct. 16, 2008

Related U.S. Application Data

(60) Provisional application No. 60/922,693, filed on Apr. 10, 2007.

(51) Int. Cl.
*F41B 15/04* (2006.01)
*H05F 3/02* (2006.01)

(52) U.S. Cl. ..... 361/232; 361/230; 361/223

(58) Field of Classification Search ..... 361/232, 361/230, 223

See application file for complete search history.

(56) References Cited

U.S. PATENT DOCUMENTS

| | | | | |
|---|---|---|---|---|
| 3,693,627 | A * | 9/1972 | Berkovits | 607/15 |
| 3,722,788 | A | 3/1973 | Petrecz | |
| 4,153,009 | A | 5/1979 | Boyle | |
| 4,167,036 | A * | 9/1979 | Kenney | 363/61 |
| 4,719,695 | A * | 1/1988 | Sturner | 29/760 |
| 4,869,015 | A | 9/1989 | Murakami et al. | |
| 4,945,860 | A | 8/1990 | Walker | |
| 5,406,734 | A | 4/1995 | Ho | |
| 5,988,450 | A * | 11/1999 | Cassarino | 222/192 |
| 6,003,474 | A | 12/1999 | Slater | |
| 6,079,367 | A | 6/2000 | Stapelfeld | |
| 6,628,025 | B2 * | 9/2003 | Ibata et al. | 310/81 |
| 6,707,659 | B2 * | 3/2004 | Hee | 361/223 |
| 2008/0047459 | A1 | 2/2008 | Novellit | |
| 2008/0064339 | A1 * | 3/2008 | Cavalier | 455/66.1 |
| 2008/0259520 | A1 | 10/2008 | Brundula | |
| 2009/0034146 | A1 | 2/2009 | Hurly | |
| 2009/0219664 | A1 | 9/2009 | Smith | |
| 2010/0008012 | A1 | 1/2010 | Ben-Yaakov | |
| 2010/0146835 | A1 | 6/2010 | McNulty | |
| 2010/0214714 | A1 | 8/2010 | Stethem | |

OTHER PUBLICATIONS

Electric Man, Copyright of May 1989, pp. 1 through 17, U.S.A.

* cited by examiner

*Primary Examiner*—Stephen W Jackson
*Assistant Examiner*—Zeev Kitov
(74) *Attorney, Agent, or Firm*—Risso & Associates; Marcus Risso

(57) ABSTRACT

A concealable electric shock device is described. The concealable electric shock device includes a housing that allows a user to affix the device against the user's body to "electrify" the user. The device is formed to accommodate a DC power source (e.g., 12 volt battery) and convert the DC power to a high-voltage AC power. Both a primary on/off switch and a secondary on/off switch (e.g., magnetic reed switch) are included to allow a user to selectively become electrified. Additionally, a user-side electrical contact is attached with the housing to provide AC power directly to a user's body. A flash system (e.g., flash bulb) is also included to allow a user to selectively generate a flash effect. Finally, a messaging system (e.g., vibrator motor) is included to allow a user's assistant to discreetly provide messages to the user, thereby providing the illusion of mentalism.

16 Claims, 7 Drawing Sheets

CONCEALABLE ELECTRIC SHOCK DEVICE

PRIORITY CLAIM

The present application is a Non-Provisional patent application, claiming the benefit of priority of U.S. Provisional Application No. 60/922,693, filed on Apr. 10, 2007, entitled, "Electric Touch."

BACKGROUND OF THE INVENTION (1. ) Field of Invention

The present invention relates to props and gimmicks used in the field of magic to create a variety of illusions and, more particularly, to a concealable electric shock device that allows a magician to discharge static electricity between the user's body and a person or object that is being touched.

(2. ) Description of Related Art

The present invention relates to props and gimmicks used in the field of magic, carried on the person and hidden underneath the clothing of the magician, and used to create the illusion of discharging static electricity.

In order to discharge static electricity, a device is required that electrifies the user so that the static electricity is discharged when the user touches another person or object. However, as can be appreciated, it would be undesirable for a user to constantly be "electrified," which would likely result in unintentional electrical discharges.

Thus, a continuing need exists for a concealable electric shock device that allows a user to secretly and selectively become electrified and thereby provide the illusion of being able to discharge static electricity at will.

SUMMARY OF INVENTION

The present invention relates to props and gimmicks used in the field of magic to create a variety of illusions. More specifically, the present invention is a concealable electric shock device that allows a magician to discharge static electricity between the user's body and the person or object that is being touched.

The concealable electric shock device includes a housing that is formed to accommodate a DC power source (e.g., 12 volt battery) that provides DC power to the device. A DC-to-AC power inverter is encased within the housing and is capable of converting the DC power to AC power. A multiplier is encased within the housing and is electrically connected with the DC-to-AC power inverter to multiply the AC power. An external ground is electrically connected with the multiplier to ground the AC power to a ground surface. A primary on/off switch is attached with the housing and electrically connectable with the DC power source. Further, a secondary on/off switch is electrically connected with the DC-to-AC power inverter and the primary on/off switch to allow a user to selectively provide DC power to the DC-to-AC power inverter. Additionally, a user-side electrical contact is electrically connected with the multiplier to provide AC power directly to a user's body. Finally, an attachment mechanism is attached with the housing for affixing the concealable electric shock device against a user's body.

In another aspect, the secondary on/off switch is a switch selected from a group consisting of a magnetic reed switch, a heel switch, and a toe-switch.

Further, the external ground is a device selected from a group consisting of a heel grounder and an L-shaped piece of copper.

In another aspect, the secondary on/off switch is magnetic reed switch that is affixed with the external ground using a wrapping.

In yet another aspect, the present invention further comprises a flash system connected with the housing and a flash switch to allow a user to selectively cause the flash system to generate a flash of light.

In another aspect, the present invention also comprises a receiver and a messaging apparatus. The receiver is attached with the housing and is responsive to a remote transmitter, while the messaging apparatus is attached with the housing and electrically connected to the receiver. Upon receiving a signal from the remote transmitter, the receiver activates the messaging apparatus to provide a signal to a user. The messaging system is a vibrator or other suitable mechanism that is formed to vibrate and provide a vibrating sensation to a user.

Finally, as can be appreciated by one in the art, the present invention also comprises a method for forming and using the concealable electric shock device described herein. The method comprising a plurality of acts of forming and using the device as described herein. For example, the method for using the electric shock device comprises acts of attaching the concealable electric shock device to a user; activating both the primary on/off switch and the secondary on/off switch to activate the concealable electric shock device; and touching an audience member to provide a static electrical charge to the audience member.

BRIEF DESCRIPTION OF THE DRAWINGS

The objects, features and advantages of the present invention will be apparent from the following detailed descriptions of the various aspects of the invention in conjunction with reference to the following drawings, where.

DETAILED DESCRIPTION

The present invention relates to props and gimmicks used in the field of magic to create a variety of illusions and, more particularly, to a concealable electric shock device that allows a magician to discharge static electricity between the user's body and the person or object that is being touched. The following description is presented to enable one of ordinary skill in the art to make and use the invention and to incorporate it in the context of particular applications. Various modifications, as well as a variety of uses in different applications will be readily apparent to those skilled in the art, and the general principles defined herein may be applied to a wide range of embodiments. Thus, the present invention is not intended to be limited to the embodiments presented, but is to be accorded the widest scope consistent with the principles and novel features disclosed herein.

In the following detailed description, numerous specific details are set forth in order to provide a more thorough understanding of the present invention. However, it will be apparent to one skilled in the art that the present invention may be practiced without necessarily being limited to these specific details. In other instances, well-known structures and devices are shown in block diagram form, rather than in detail, in order to avoid obscuring the present invention.

The reader's attention is directed to all papers and documents which are filed concurrently with this specification and which are open to public inspection with this specification, and the contents of all such papers and documents are incorporated herein by reference. All the features disclosed in this specification, (including any accompanying claims, abstract, and drawings) may be replaced by alternative features serving the same, equivalent or similar purpose, unless expressly stated otherwise. Thus, unless expressly stated otherwise, each feature disclosed is only one example of a generic series of equivalent or similar features.

Furthermore, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of" or "act of" in the claims herein is not intended to invoke the provisions of 35 U.S.C. 112, Paragraph 6.

Please note, if used, the labels left, right, front, back, top, bottom, forward, reverse, clockwise and counter clockwise have been used for convenience purposes only and are not intended to imply any particular fixed direction. Instead, they are used to reflect relative locations and/or directions between various portions of an object.

(1. ) Description

Figure 1:
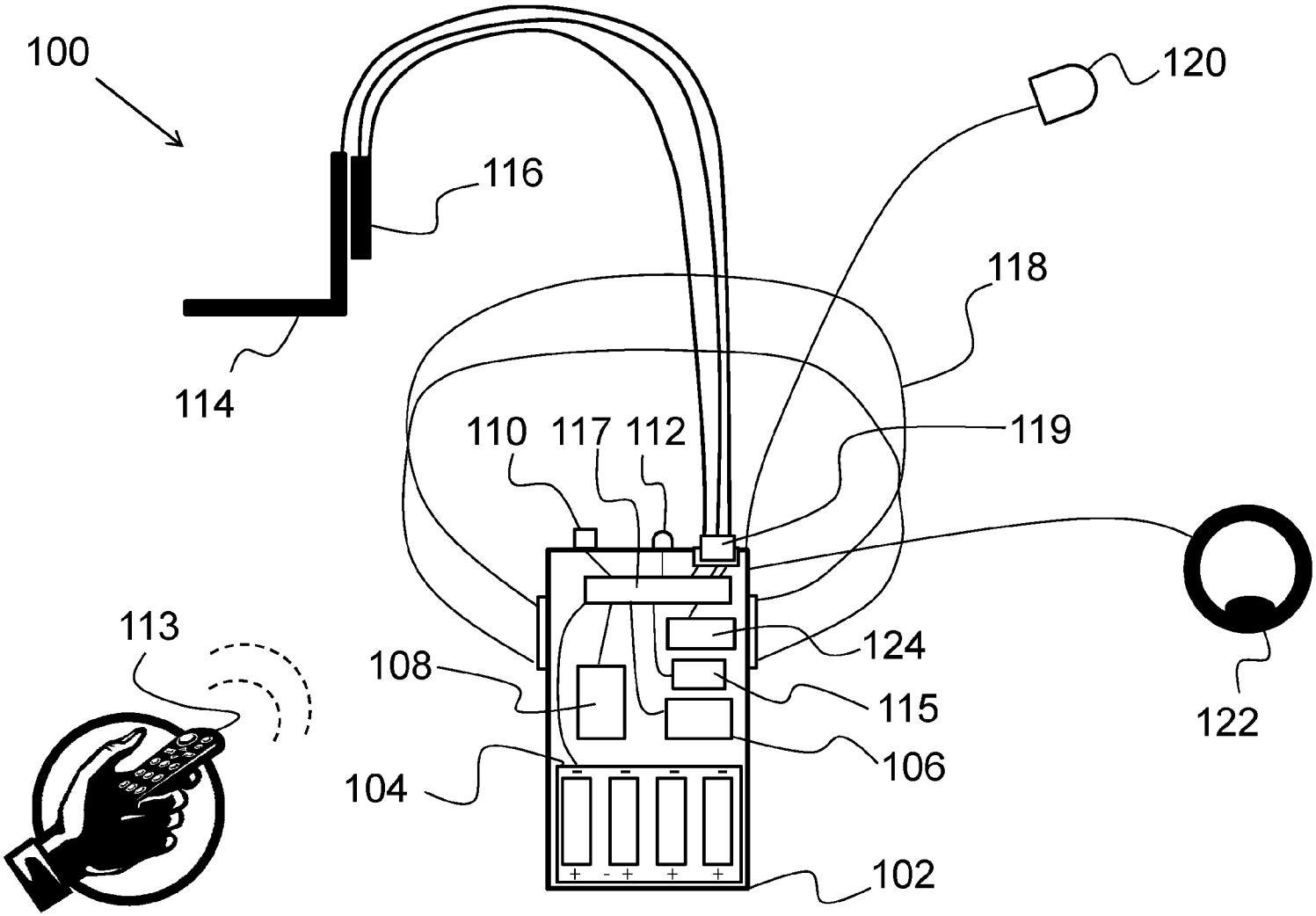
FIG. 1 is an illustration of a concealable electric shock device according to the present invention, depicting an interior of a housing.

As shown in FIG. 1, the present invention relates to a concealable electric shock device 100. The electric shock device 100 generates static electricity across a user's body. The static electricity can be used for moving small, oppositely charged items, for educational or entertainment purposes, or for discharging static electricity between the wearer's body and the person or object that is being touched. Thus, the electric shock device 100 can be used to provide a shock for entertainment, educational means, personal protection, or for therapeutic remedy.

The electric shock device 100 is capable of producing a high-voltage charge at a low-amperage rating across the body to form a static charge that can be utilized for a wide variety of uses (as mentioned above). This charge uses the body to attract other objects with dissimilar charges, or can be used to discharge the energy through contact with a person, or object that it grounded.

In operation, the electric shock device 100 generates a high-voltage alternating current (AC) charge from a low-voltage direct current (DC) source (e.g., 12 volt DC). The electric shock device 100 includes a housing 102 (depicted as being open for illustrative purposes) which houses the DC power source 104. As a non-limiting example, the DC power source 104 can be a series of 12 volt batteries. Also included is a DC-to-AC power inverter 106. The DC-to-AC power inverter 106 is any suitable converter capable of converting the DC current into conventional AC electricity. As a non-limiting example, the DC-to-AC power inverter 106 includes a circuit which forms an oscillator for converting the DC voltage to an AC low-voltage charge. Following the DC-to-AC power inverter 106 is voltage multiplier 108. The voltage multiple 108 is any suitable mechanism or device that is capable of multiplying the AC voltage to a high-voltage low-current output (e.g., approximately 12 kV), a non-limiting example of which includes a "Cockcroft-Walton" generator. Thus, the voltage multiplier 108 includes a series of capacitors and diodes that are connected to the output of the DC-to-AC power inverter 106 to multiply the AC voltage.

Also included with the electric shock device 100 are a primary on/off switch 110 and power indicator 112. The primary on/off switch 110 is any suitable mechanism or device that is capable of allowing a user to selectively turn on and off the electric shock device 100, a non-limiting example of which includes a slide switch. Further, the power indicator 112, while optional, is any suitable mechanism or device which can be used to alert a user to whether or not the electric shock device 100 is on, a non-limiting example of which includes a light-emitting diode (LED).

Figure 3:
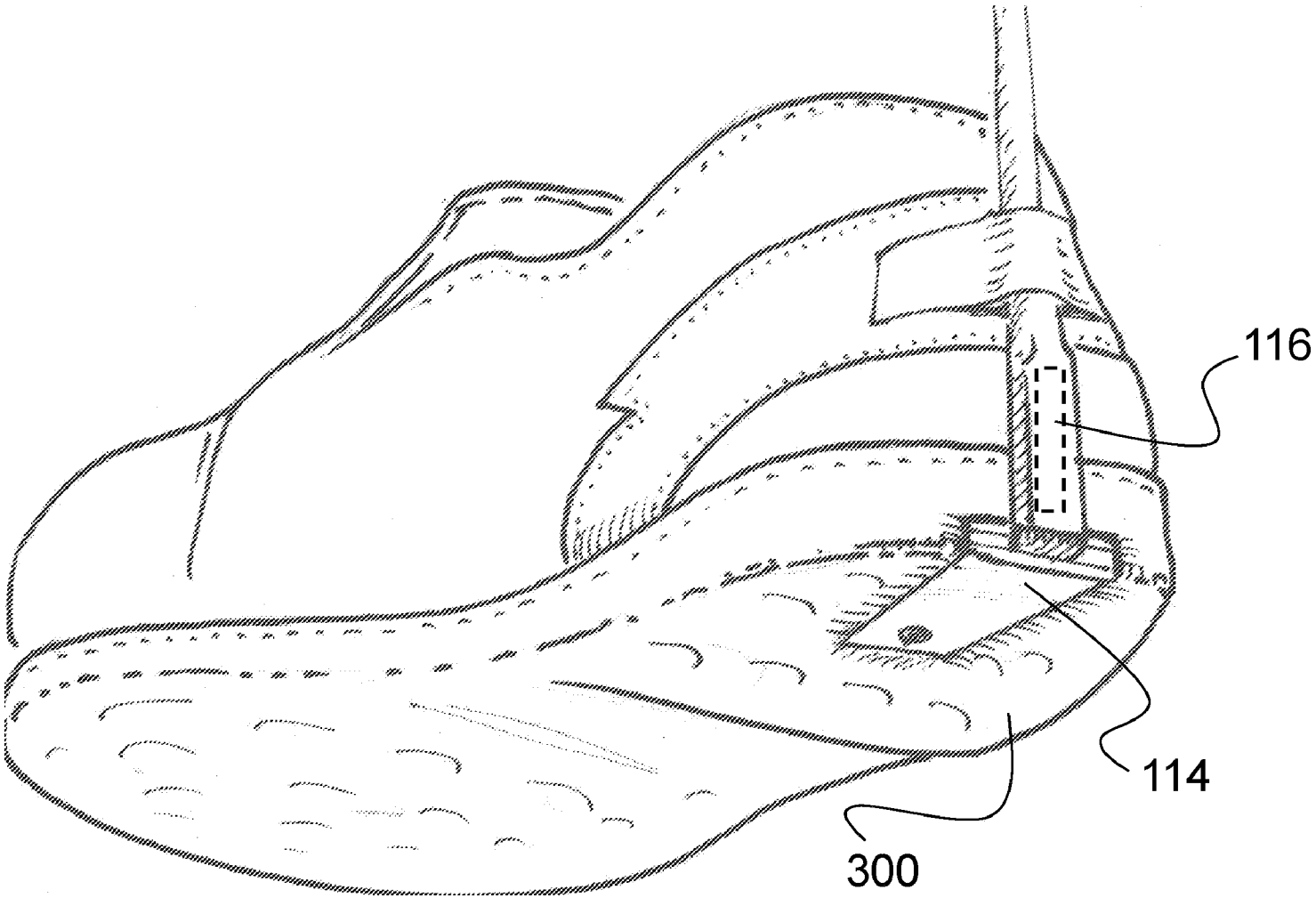
FIG. 3 is an illustration of an external ground being attached with a soul of a user's shoe.

The electric shock device 100 also includes an external ground 114. The external ground 114 is any suitably mechanism or device that allows the electric shock device 100 to be in contact with a ground (e.g., floor) surface and thereby ground the electric shock device 100, a non-limiting example of which includes an electrically conductive material (e.g., metal) that is electrically connected with the voltage multiple 108. In one aspect, the external ground 114 is an "L-shaped" piece of copper that can be fitted to the sole of a user's shoe (depicted again in FIG. 3). In another aspect, the external ground 114 can be a heel grounder. A heel grounder is generally a strap that is worn outside of the user's shoe that includes a conductive/rubber material that is capable of grounding the charge. In this aspect, an electrically conductive wire would be attached from the heel grounder to the main unit (i.e., the electric shock device 100 and applicable components). Additionally, in another aspect, positioned somewhere along the heel ground (e.g., on the back or on the side of the heel grounder) can be a regular button, which could be used to replace the magnetic reed switch and can turn on the electric shock device 100 when the user taps it with the opposite foot.

Also included is a secondary on/off switch 116. The secondary on/off switch 116 allows a user to selectively and secretly activate the electric shock device 100. In other words, while performing a trick or otherwise operating the electric shock device 100, it may be desirable to allow the user to turn on the electric shock device 100 while not alerting an audience. Thus, in order to for the electric shock device 100 to work, both the primary on/off switch 110 AND the secondary on/off switch 116 must be activated (i.e., on position). The secondary on/off switch 116 is any suitable mechanism or device that is capable of allowing a user to selectively turn on and off the electric shock device 100, a non-limiting example of which includes a magnetic reed switch. Other non-limiting examples of the secondary on/off switch 116 include a toe-switch, a heel switch, and a remote control transmitter and corresponding receiver (housed in the housing 102) which can be selectively controlled by the user or by an assistant. The toe-switch is a switch that attaches with the user's toe and can be activated by using the toe to depress a button on the toe-switch. Alternatively, with a remote control transmitter 113, the electric shock device 100 would include a receiver 115 that allows a user to remotely activate the secondary on/off switch 110. It should be understood that the electric shock device 100 does not require a remote control transmitter 113 and receiver 115 to operate and provide the shock effect, but that this is an optional and/or alternative aspect.

It should also be noted that the wires connecting the external ground 114 and/or the secondary on/off switch 116 are connected with the housing 102 (and thereby the requisite components) directly or through the use of a removable connector 119. The removable connector 119 operates as a plug that allows the user to selectively attached the external components (e.g., external ground 114 and/or secondary on/off switch 116) with the electric shock device 100.

Further, as can be appreciated by one skilled in the art, the present invention can also include a control circuit 117 which is used to electrically connect all of the respective components. It should also be noted that the components can be directly connected to one another or be part of the control circuit 117 that provides for the setup and electrical connections. In other words, while the control circuit 117 provides for a convenient electrical connection circuit, it is not required as the components can be directly wired to one another as appropriate to provide the functionality described herein.

As noted above, while using the electric shock device 100, it is desirable to conceal the device so as not to alert an audience that the magician, etc., is using some form of an electric device to generate the shock effect. Thus, the electric shock device 100 includes an attachment mechanism 118. The attachment mechanism 118 is any suitable mechanism or device that allows the electric shock device 100 to be attached with a user's body, a non-limiting example of which includes an elastic strap.

Figure 2:
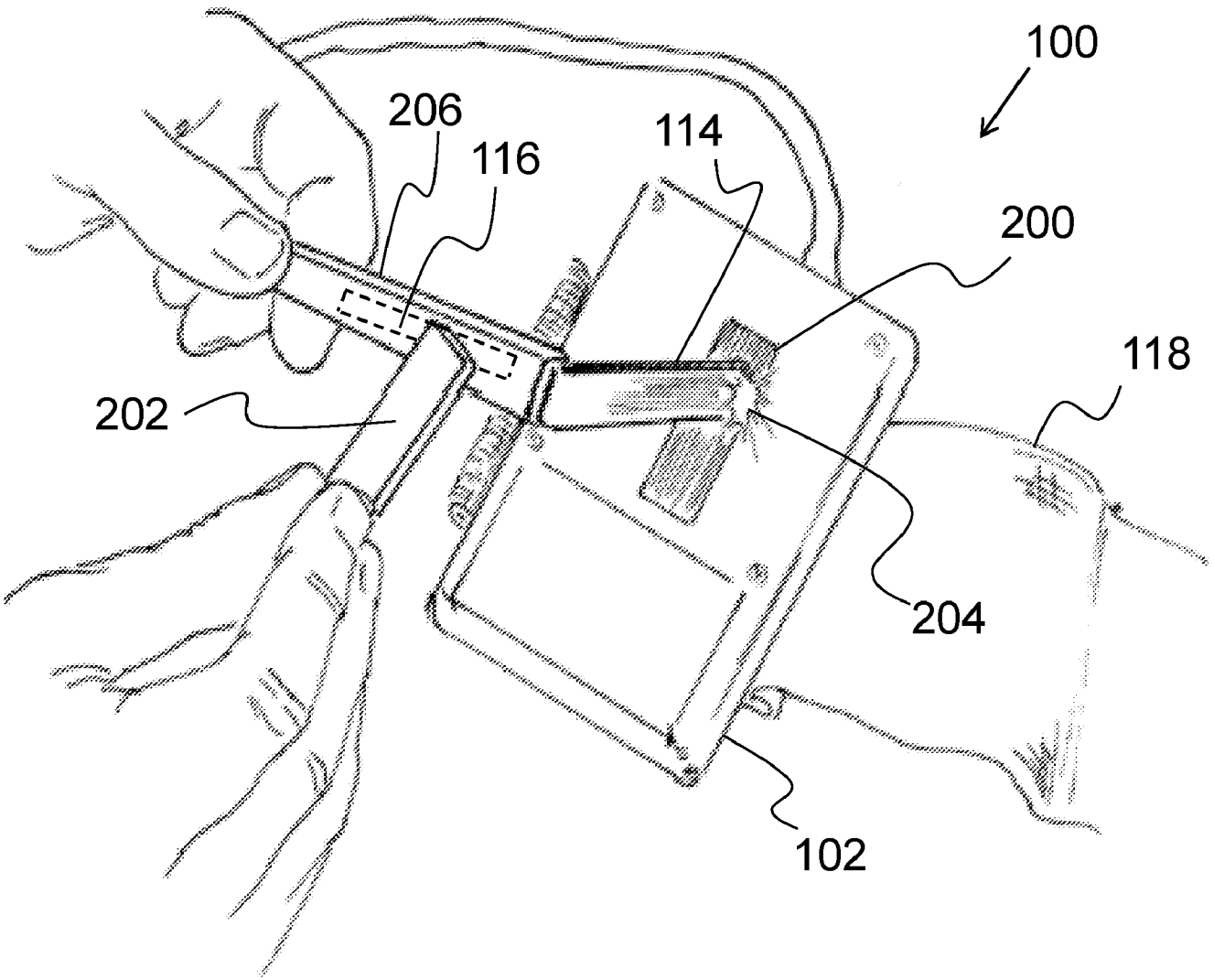
FIG. 2 is an illustration of the concealable electric shock device according to the present invention, depicting a back side of the housing.

As noted above, the electric shock device 100 includes an external ground 114. However, it can also be appreciated that in order to allow a user to directly shock another person, the current must pass through the user. Thus, as depicted in FIG. 2, the electric shock device 100 includes a user-side electrical contact 200 that is electrically connected with the multiplier and that can pass an electrical current to the user. The user-side electrical contact 200 is any suitable mechanism or device that can pass a charge or current to the user, a non-limiting example of which includes an electrically conductive material (e.g., metal) that is electrically connected with the multiplier. FIG. 2 illustrates a back side of the housing 102, showing the user-side electrical contact 200. Thus, using the attachment mechanism 118, a user can attach the housing 102 directly to the user's body (e.g., leg calf), which forces the user-side electrical contact 200 to contact the user's skin.

Also depicted in FIG. 2 is the secondary on/off switch 116, which in this example is a magnetic reed switch. In order to operate the magnetic reed switch, an external magnet 202 must be used, which causes the magnetic reeds within the secondary on/off switch 116 to complete the circuit and activate the electric shock device 100 (note that a wrapping 206, such as a shrink tube or shrink wrap, is used to affix the magnetic reed switch to the external ground 200).

Once activated, a user can check for an electrical spark 204 to ensure that the device is active and working properly. For example, by positioning the external ground 114 against the user-side electrical contact, a spark 204 should be generated.

Figure 7B:
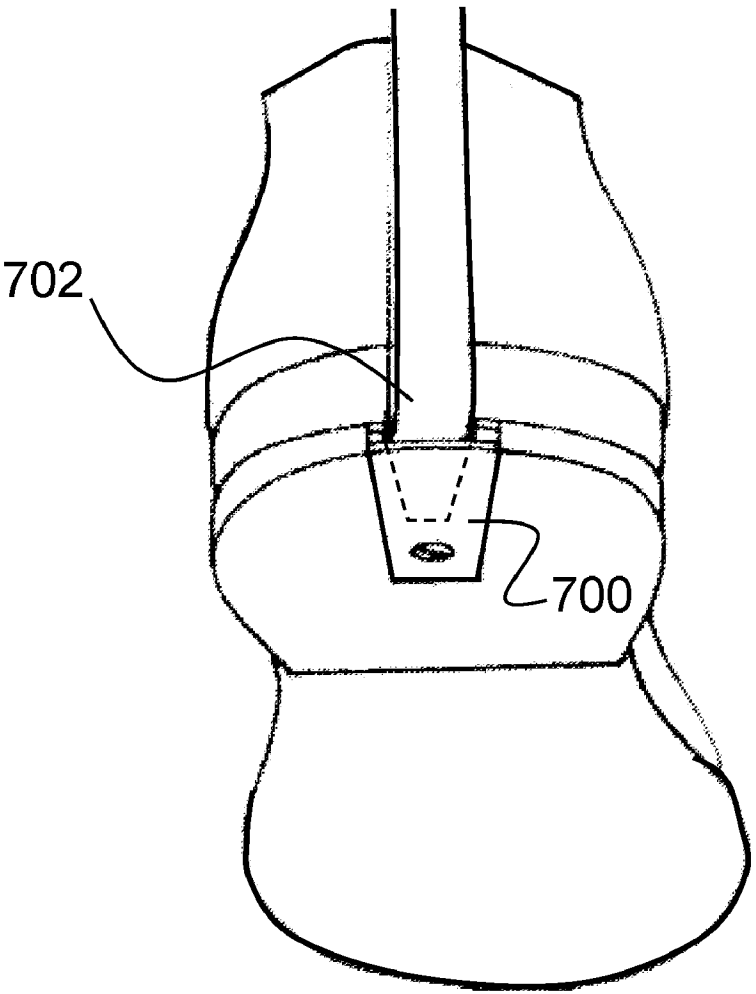
FIG. 7B is an illustration of a user's shoe, depicting a copper conductor slid within the metal housing.
Figure 7A:
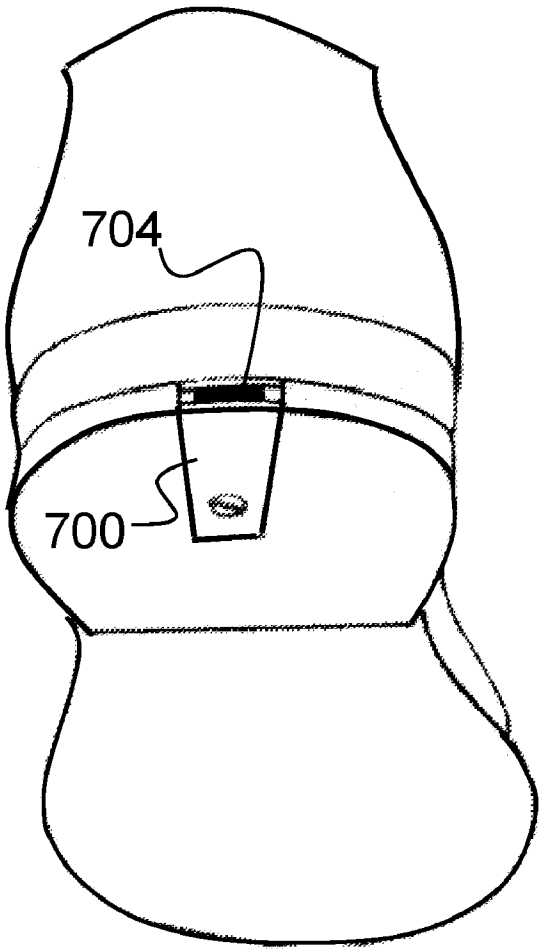
FIG. 7A is an illustration of a user's shoe, depicting a metal housing attached with the sole of the shoe.

As noted above and as shown in FIG. 3, the external ground 114 must be positioned in such a manner that it is capable of contacting a ground surface to sufficiently operate as a ground. Thus, for example, an "L-shaped" piece of copper can be fitted to the sole 300 of a user's shoe. As another example and as depicted in FIGS. 7A and 7B, the external ground can be formed of a metal housing 700 and an L-shaped copper conductor 702 that fits within the metal housing 700. In this example, the metal housing 700 includes a hole 704 in which the L-shaped copper conductor 702 can slide. This configuration also positions the secondary on/off switch 116 (e.g., magnetic reed switch) near the heel of the user's shoe. Such positioning of the magnetic reed switch enables a user to secretly activate the electric shock device.

Figure 4:
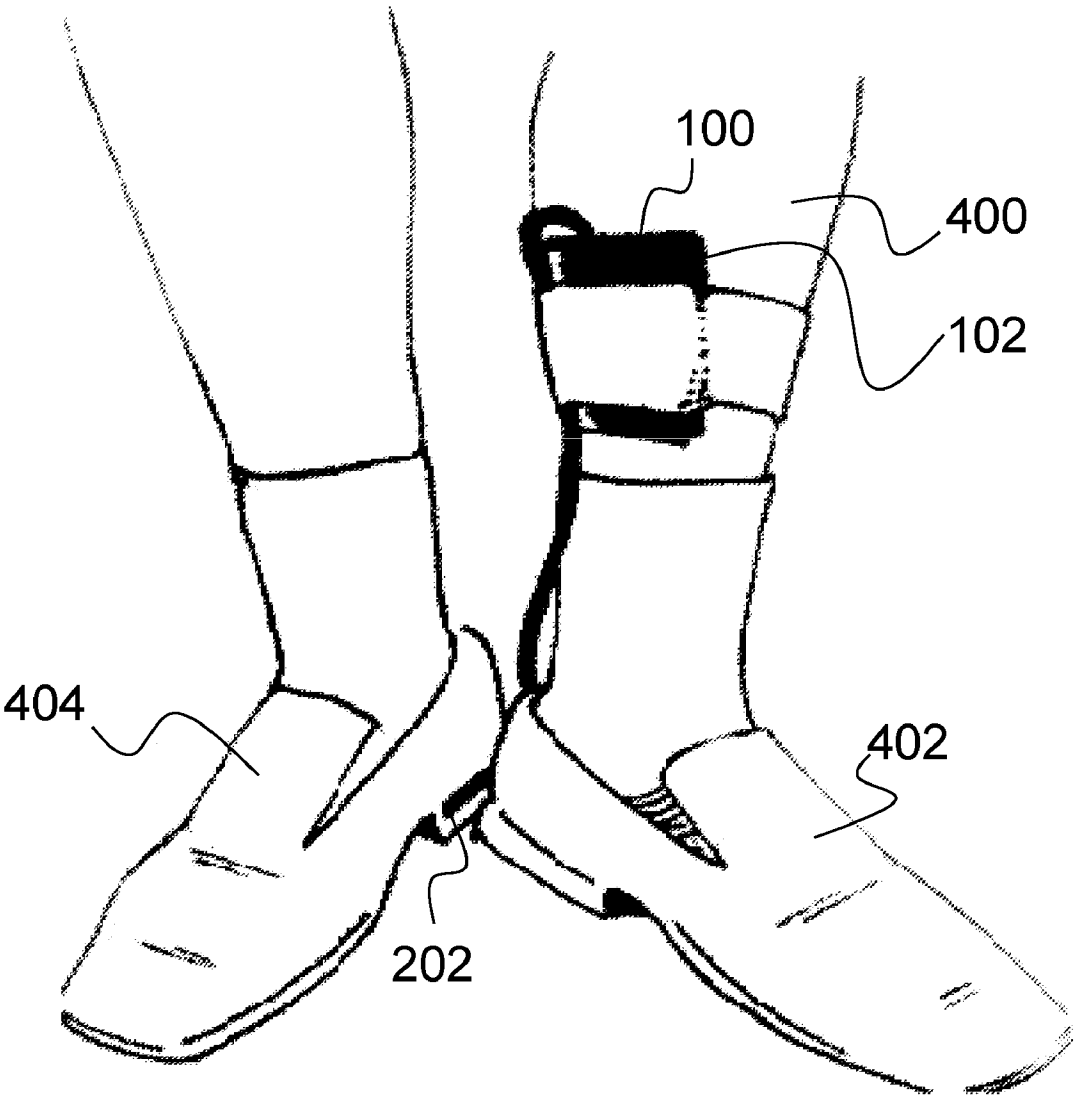
FIG. 4 is an illustration of the concealable electric shock device according to the present invention, depicting the concealable electric shock device as being attached with a user's leg.

For example and as illustrated in FIG. 4, the electric shock device 100 can be affixed with a user's leg 400, while the external ground (not shown) affixed with the user's first shoe 402 and thereby grounded. Additionally, in this aspect, the magnetic reed switch is affixed with the heel of the user's first shoe 402. To secretly activate the electric shock device 100, the external magnet 202 can be attached (e.g., taped, glued, etc.) to the user's second shoe 404. When the external magnet 202 is brought into contact with (or at least nearby) the magnetic reed switch, the electric shock device 100 is activated to "electrify" the user.

FIG. 4 illustrates the housing 102 as being a case-like unit that can be directly affixed with the user's body. However, it can be appreciated by one skilled in the art that the housing 102 can take on any suitable form to provide the functions described herein. As a non-limiting example, the electric shock device 100 can be formed directly into the shoe (not shown) such that the shoe itself is the housing 102. For example, the electric shock device 100 and its components can be built into the heel of the shoe, or at any other suitable location (e.g., within the sole of the shoe).

Figure 5:
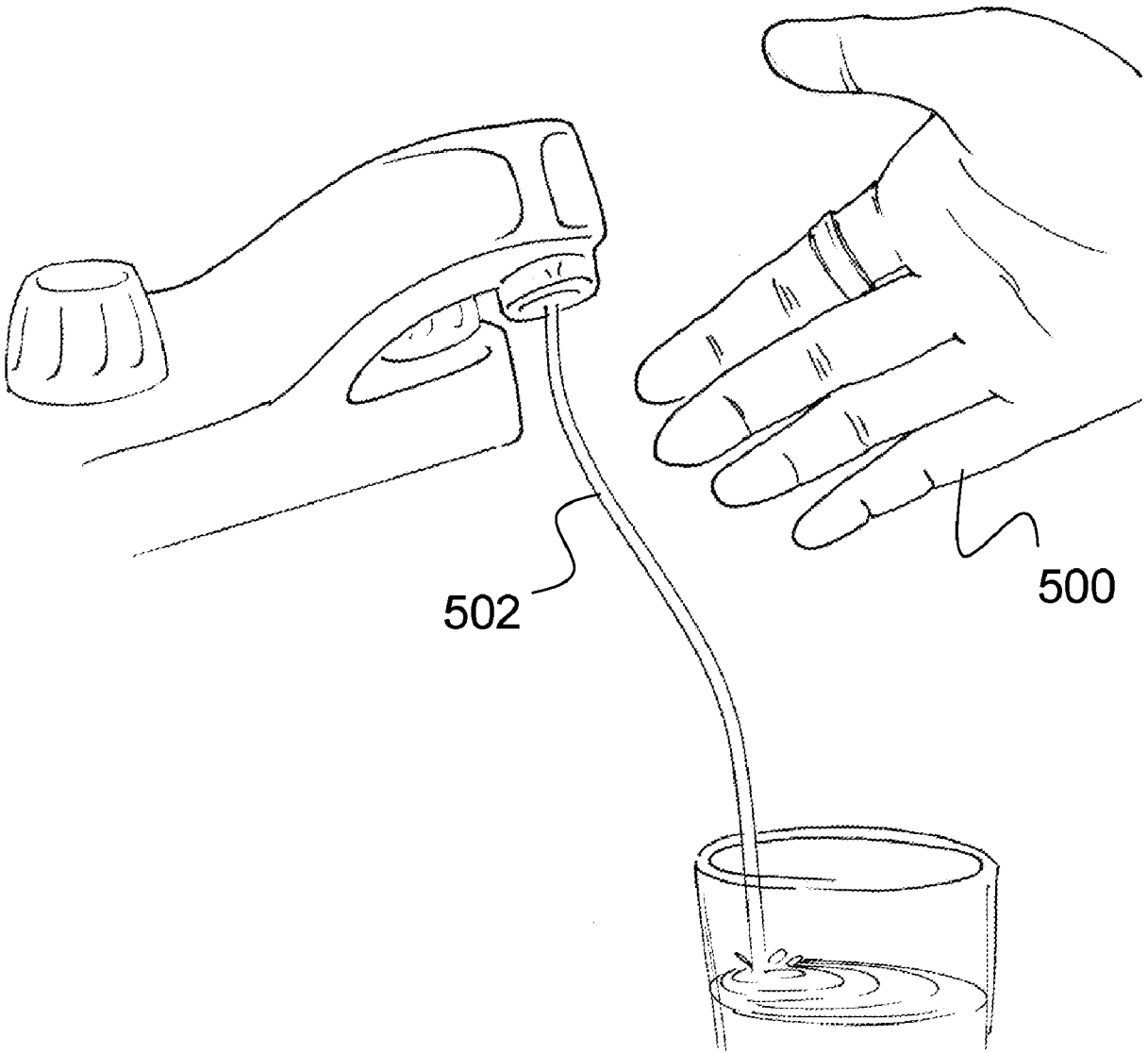
FIG. 5 is an illustration of a user using static electricity to bend a stream of water while using the present invention.

As noted above, when both the primary on/off switch AND the secondary on/off switch are activated, a current is passed through the user-side electrical contact into the user. The charge can be passed directly to an audience member, thereby shocking them. However, as can be appreciated by one skilled in the art, the charge also creates static electricity within the user which can be used for other effects, such as moving small objects (e.g., paper shavings) or bending water. As shown in FIG. 5, when "electrified," the user can place their hand 500 or other body part near a stream of water 502, which, through the static electricity, actually causes the stream of water 502 to bend. Thus, the electric shock device can be used to provide a variety of effects.

Further, the electric shock device 100 can also be formed to provide additional functionality. For example and referring again to FIG. 1, a flash system 120 can be attached with the housing 102 and electrically connected with the control circuit 117 or any other suitable components in order to allow for operation thereof. The flash system 120 includes a flash bulb that provides bright and fast flash. The flash system 120 can be operated using a variety of techniques. For example, a flash switch 122 (e.g., toe-switch or any other suitable switch mechanism or device) can be connected with the flash system 122 to allow the user to secretly and selectively activate the flash system 120. The flash system 120 is a flash bulb that can be worn beneath the user's shirt, which when triggered, projects a burst of light. The flash of light simulates a flame or fire effect in an attempt to slightly disorient the viewer into not realizing how an effect took place.

To provide yet additional functionality to the electric shock device 100, a messaging apparatus 124 is attached with the housing 102 and electrically connected with the control circuit 117. The messaging apparatus 124 is any suitable mechanism or device that allows for discrete communication between a user (e.g., magician) and the user's assistant (e.g., magician's assistant), a non-limiting example of which includes a motor that provides a vibrating sensation (e.g., a miniature motor with a lop-sided shaft weight, similar to a pager motor). To allow the user's assistant to discretely transmit a message to the user, the present invention also includes a remote transmitter 113, with a corresponding receiver 115 encased within the housing 102 and electrically connected with the control circuit 117. Activating (e.g., depressing a button) the remote transmitter 113 would then send a signal to the receiver 115 which would then cause the motor to provide the vibrating sensation.

Thus, by providing a vibrating sensation to the user, the user's assistant can provide the user with a variety of messages which creates the illusion of extra sensory perception. For example, suppose a magician was supposed to think of a specific number. The magician's assistant, who knows the number, can activate the remote transmitter 113 a certain number of times (e.g., ten) to indicate a particular number back to the magician (e.g., ten). When the magician receives the message, the magician would feel it as a vibrating pulse on the magician's body. The magician could then simply count the number of pulses to determine what the secret number was.

Figure 6:
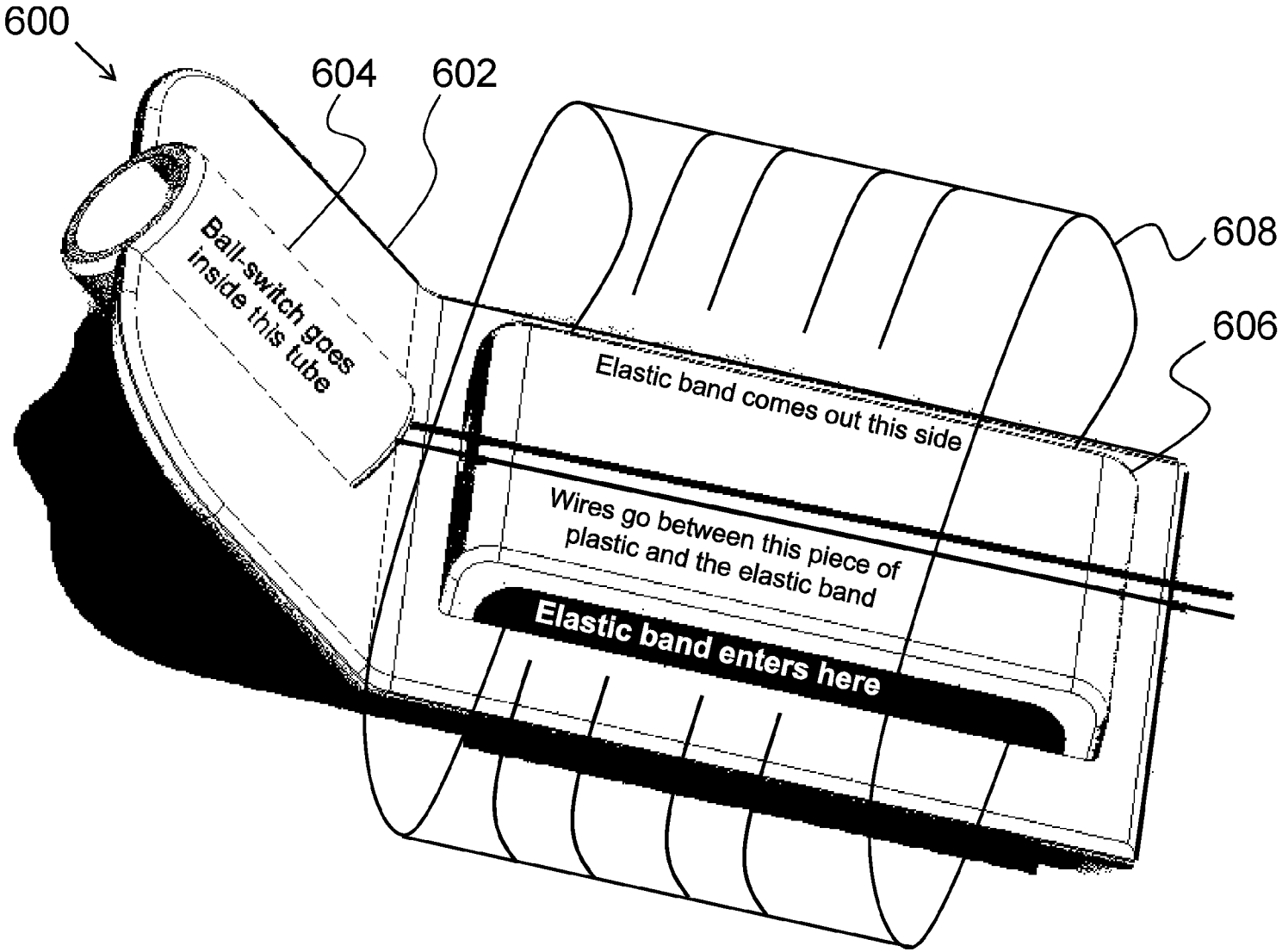
FIG. 6 is an illustration of a toe-switch according to the present invention.

As mentioned briefly above, the present invention could optionally be used with a toe-switch. A single toe-switch or a plurality of toe-switches can be used with the electric shock device 100 in place of any of the switches listed above. For further illustration, FIG. 6 depicts an example of a toe-switch 600 that can be used with the present invention. The toe-switch 600 is essentially a concealable switch device that is operated by a user's toe by being attached to the toe. More specifically, in this non-limiting example, the toe-switch includes an angled frame 602 with an attachment 604 (e.g., tube) for placement of a switching device (e.g., ball switch). The angled frame 602 also includes a strap attachment 606 that allows for attachment of an elastic band 608 thereto. Thus, as depicted, the elastic band 608 forms a loop that can be positioned around the user's toe. Once attached with the user's toe, by depressing the switching device, the toe-switch 600 can be used to control any of the said components that may be attached thereto.

In summary, the present invention is a concealable electric shock device 100 that allows a user to secretly and selectively become "electrified" to discharge static electricity between the user's body and a person or object that is being touched. The electric shock device 100 also includes a flash system 120 that, when activated, provides a bright and brief flash of light in an attempt to disorient an audience. Finally, the electric shock device 100 also includes a messaging apparatus 124 that allows a user's assistant to discretely send messages to the user to provide the illusion of mentalism.

What is claimed is:

1. A concealable electric shock device, comprising;

a housing, the housing being formed to accommodate a DC power source that provides DC power;

a DC-to-AC power inverter attached with the housing and being capable of converting the DC power to AC power;

a multiplier attached with the housing and electrically connected with the DC-to-AC power inverter to multiply the AC power;

an external ground electrically connected with the multiplier to ground the AC power to a ground surface, wherein the external ground is formed to attach with a user's shoe and ground the AC power directly to the ground surface;

a primary on/off switch attached with the housing and electrically connectable with the DC power source;

an attachment mechanism attached with the housing for affixing the concealable electric shock device against a user's body;

a hands-free secondary on/off switch electrically connected with the primary on/off switch to allow a user to selectively activate the concealable electric shock device; and a user-side electrical contact electrically connected with the multiplier and the housing, the user-side electrical contact being formed to provide AC power directly to a user's body when the housing is affixed against the user's body, whereby upon affixing the housing to the user's body and activating both the primary and secondary on/off switches, a user can provide a static electrical charge to an audience member by directly touching the audience member.

2. A concealable electric shock device as set forth in claim 1, wherein the secondary on/off switch is electrically connected with the DC-to-AC power inverter and the primary on/off switch to allow a user to selectively provide DC power to the DC-to-AC power inverter.

3. A concealable electric shock device as set forth in claim 2, wherein the secondary on/off switch is a switch selected from a group consisting of a magnetic reed switch, a heel switch, and a toe-switch.

4. A concealable electric shock device as set forth in claim 3, wherein the secondary on/off switch is a magnetic reed switch that is affixed with the external ground using a wrapping.

5. A concealable electric shock device as set forth in claim 4, further comprising a flash system connected with the housing and a flash switch to allow a user to selectively cause the flash system to generate a flash of light.

6. A concealable electric shock device as set forth in claim 5, further comprising:

a receiver attached with the housing, the receiver being responsive to a remote transmitter;

a messaging apparatus attached with the housing and electrically connected with the receiver, such that upon receiving a signal from the remote transmitter, the receiver activates the messaging apparatus to provide a signal to a user.

7. A concealable electric shock device as set forth in claim 6, wherein the messaging apparatus is a motor that is formed to provide a vibrating sensation to a user.

8. A concealable electric shock device as set forth in claim 1, wherein the secondary on/off switch is a switch selected from a group consisting of a magnetic reed switch, a heel switch, and a toe-switch.

9. A concealable electric shock device as set forth in claim 1, wherein the secondary on/off switch is a magnetic reed switch that is affixed with the external ground using a wrapping.

10. A concealable electric shock device as set forth in claim 1, further comprising a flash system connected with the housing and a flash switch to allow a user to selectively cause the flash system to generate a flash of light.

11. A concealable electric shock device as set forth in claim 1, further comprising:

a receiver attached with the housing, the receiver being responsive to a remote transmitter;

a messaging apparatus attached with the housing and electrically connected with the receiver, such that upon receiving a signal from the remote transmitter, the receiver activates the messaging apparatus to provide a signal to a user.

12. A concealable electric shock device as set forth in claim 11, wherein the messaging apparatus is a motor that is formed to provide a vibrating sensation to a user.

13. A method for providing a electric shock to an audience member using a concealable electric shock device, comprising acts of:

attaching a concealable electric shock device with a user's body, the concealable electric shock device comprising:

a housing, the housing being formed to accommodate a DC power source that provides DC power;

a DC-to-AC power inverter attached with the housing and being capable of converting the DC power to AC power;

a multiplier attached with the housing and electrically connected with the DC-to-AC power inverter to multiply the AC power;

an external ground electrically connected with the multiplier to ground the AC power to a ground surface;

a primary on/off switch attached with the housing and electrically connectable with the DC power source;

a secondary on/off switch electrically connected with the primary on/off switch to allow a user to selectively activate the concealable electric shock device; and a user-side electrical contact electrically connected with the multiplier and being formed to provide AC power directly to a user's body;

activating both the primary on/off switch and the secondary on/off switch to activate the concealable electric shock device; and touching an audience member to provide a static electrical charge to the audience member.

14. A concealable electric shock device as set forth in claim 1, wherein the external ground includes a metal housing and an L-shaped copper conductor for positioning within the metal housing.

15. A concealable electric shock device as set forth in claim 14, further comprising a user's shoe with the metal housing affixed with the sole of the user's shoe, with the L-shaped copper conductor positioned within the metal housing.

16. A concealable electric shock device, comprising;

a housing, the housing being formed to accommodate a DC power source that provides DC power;

a DC-to-AC power inverter attached with the housing and being capable of converting the DC power to AC power;

a multiplier attached with the housing and electrically connected with the DC-to-AC power inverter to multiply the AC power;

an external ground electrically connected with the multiplier to ground the AC power to a ground surface, the external ground being formed to attach with the sole of a user's first shoe and ground the AC power to the ground surface;

a primary on/off switch attached with the housing and electrically connectable with the DC power source;

an attachment mechanism attached with the housing for affixing the concealable electric shock device against a user's body;

a secondary on/off switch electrically connected with the primary on/off switch to allow a user to selectively activate the concealable electric shock device;

a user-side electrical contact electrically connected with the multiplier and the housing, the user-side electrical contact being formed to provide AC power directly to a user's body when the housing is affixed against the user's body;

wherein the secondary on/off switch is a magnetic reed switch that is affixed with the external ground such when the external ground is attached with the sole of the user's first shoe, the magnetic reed switch is attached with the heel of the user's first shoe; and a separate magnet for attaching with the user's second shoe and activating the magnetic reed switch, whereby upon affixing the housing to the user's body and bringing the user's shoes together to activate the secondary on/off switch, a user can provide a static electrical charge to an audience member by physically touching the audience member.

* * * * *